US005088154A

United States Patent [19]

Ishikawa

[11] Patent Number: 5,088,154

[45] Date of Patent: Feb. 18, 1992

[54] DOOR HINGE SYSTEM

[75] Inventor: Masayoshi Ishikawa, Toyama, Japan

[73] Assignee: Yoshida Kogyo K.K., Japan

[21] Appl. No.: 501,013

[22] Filed: Mar. 29, 1990

[30] Foreign Application Priority Data

Mar. 29, 1989 [JP] Japan ..... 1-77806

[51] Int. Cl.[5] ..... E05D 5/02; E05D 7/12

[52] U.S. Cl. ..... 16/252; 16/270; 16/382

[58] Field of Search ..... 16/252, 249, 270, 271, 16/272, 382

[56] References Cited

U.S. PATENT DOCUMENTS 3,225,381 12/1965 Fountain .
3,590,419 7/1971 Dargene ..... 16/235
4,689,853 9/1987 Marinoni .

FOREIGN PATENT DOCUMENTS 0073166 3/1983 European Pat. Off. .
1421041 1/1976 United Kingdom .
2069577 8/1981 United Kingdom .
2089423 6/1982 United Kingdom .

*Primary Examiner*—Robert L. Spruill
*Assistant Examiner*—Carmine Cuda
*Attorney, Agent, or Firm*—Hill, Van Santen, Steadman & Simpson

[57] ABSTRACT

The present invention relates to a door hinge system which can be mounted readily on a door body in a short time and which comprises a hinge member to be fixedly secured to a stile member of the door body, and a support member for supporting the hinge member from under or from above. The hinge member has a mounting surface portion which is formed on one side surface thereof and which has mounting screw-threaded holes perforated therein. This mounting surface portion is fixedly secured by means of fasteners through a seating plate to one side wall of the stile member of the door body. The portion of the side wall to be fitted with the hinge system is positioned relative to the mounting surface portion by insert portion(s) and engaging portions located at predetermined positions on the mounting surface portion.

5 Claims, 5 Drawing Sheets

DOOR HINGE SYSTEM

BACKGROUND OF THE INVENTION

1. Field of the Invention

This invention relates to a hinge system adapted to be mounted on the body of a door provided in the entrance, and an entrance and exit of a room, or of a kitchen door, etc., 2. Description of the Prior Art In prior art or conventional hinge systems mounted on door bodies, their hinge members are usually mounted on stile members of door bodies as follows. Stating in brief, as shown in FIGS. 1 and 2, fasteners (such as, for example, bolts) D are passed from inside the mounting end of the stile member C of the door body through insertion holes E perforated through the wall of the stile member C and then threadably engaged with screw-threaded holes B formed in a hinge member A for purposes of fixedly securing the door body, and then the fasteners or bolts D are fully tightened thereby mounting the hinge member A on the stile member C of the door body. (Refer, for example, to U.S. Pat. No. 3,225,381).

In the above-mentioned prior art hinge system, however, after the hinge member A is located at a predetermined position on the stile member C of the door body, the fixing bolts D are passed one by one from inside the narrow mounting end of the stile member C through the insertion holes E in the stile member C, and threadably engaged with the screw-threaded holes B formed in the hinge member A, and then the fasteners are tightened fully. Therefore, the operation itself is troublesome and, in particular, in case long bolts are used as the fasteners, it is very difficult to perform the hinge attaching operations.

SUMMARY OF THE INVENTION

The present invention has been made in view of the above-mentioned circumstances in the prior art, and has for its object to provide a door hinge system wherein the hinge mounting operation can be made easily and in a short time.

To achieve the above-mentioned object, according to a first aspect of the present invention, there is provided a hinge system consisting of a hinge member adapted to be fixedly secured to a side wall of a stile member of a door body on the mounting side thereof, and a support member for supporting the hinge member from under or from above, the hinge system comprising: a mounting surface portion formed on one side surface of the hinge member, the mounting surface portion having a plurality of mounting screw-threaded holes formed therein in vertically spaced-apart and parallel relationship with each other; fasteners adapted to be threadably engaged with the mounting screw-threaded holes, respectively, to fixedly secure the hinge member to the side wall of the stile member; insert portion(s) located adjacent to the entry parts of the mounting screw-threaded holes and adapted to be inserted into a guide notch, for passage of the fasteners, formed in the side wall of the stile member; engaging portions located on the left and right side of the lower part of the mounting surface portion near the support member and adapted to be engaged with or fitted in slots formed in the side wall of the stile member on the mounting side thereof; and a seating plate adapted to be abutted against the inner surface of the side wall of the stile member on the mounting side thereof and fixedly secured thereto by means of the fasteners, the arrangement being made such that the hinge member is fixedly secured to the stile member by temporarily tightening the seating plate onto the mounting surface portion of the hinge member by means of the fasteners, inserting the hinge member from an opening formed in the lower part of the stile member into the guide notch and the slots in such a manner that the side wall may be located at a predetermined position between the seating plate and the mounting surface portion, and then tightening the fasteners fully or satisfactorily.

According to a second aspect of the present invention, there is provided a door hinge system as set forth in the first aspect, characterized in that the insert portion(s) and the engaging portions are formed on a plate-shaped member formed separately from the hinge member.

Further, according to a third aspect of the present invention, there is provided a door hinge system as set forth in the first aspect, characterized in that the insert portion(s) and the engaging portions are formed at predetermined positions on the side surface of the seating plate facing the mounting surface portion of the hinge member.

Since the hinge system according to the present invention is constructed as mentioned hereinabove, it is possible to temporarily tighten the seating plate onto the hinge member by means of fasteners, and pull upwards the hinge member along the guide notch formed in the side wall of the stile member of the door body so as to engage the hinge member with the guide notch, and subsequently tighten the fasteners fully. As a result, the tightening operations which need to be conducted inside the stile member is reduced, and the need for passing the fasteners from inside the stile member into the hinge member can be eliminated so that the hinge mounting operation can be made easily and in a short time. Moreover, since the arrangement is made such that the loading of the door body can be supported by the insert portion(s) or projection(s) and the engaging portions and the insert portion(s) and the engaging portions are arranged to be urged by the seating plate, an excellent effect is obtained in that the mounting portion of the door body becomes structurally robust and there is no risk of the mounting portion being deformed or damaged.

Further, by providing the insert portion(s) and the engaging portions on a plate-shaped member formed separately from the hinge member, the hinge member can be manufactured easily and adapted for mass production.

Further, according to the above-mentioned third embodiment wherein the insert portion(s) and the engaging portions are formed on one side surface of the seating plate, the hinge system can be manufactured and mounted on a door much more easily.

The above-mentioned and other objects, aspects and advantages of the present invention will become apparent to those skilled in the art by making reference to the following description and the accompanying drawings in which preferred embodiments incorporating the principles of the present invention are shown by way of illustration only.

DETAILED DESCRIPTION OF PREFERRED EMBODIMENTS

The present invention will now be described by way of several examples with reference to the accompanying drawings, and in particular FIGS. 3 to 8.

Figure 5:
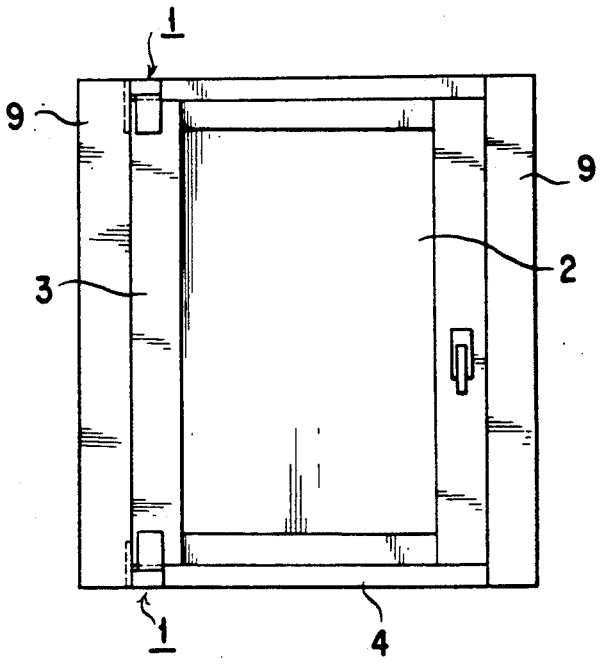
FIG. 5 is an overall front view of the indoor side of the door.

A door hinge system according to the present invention comprises a hinge member mounted on a stile member of a door body, and a support member for supporting the hinge member from above or from below, and the arrangement is made such that fasteners tightened temporarily through a seating plate to the hinge member are mounted on the stile member of the door body, and then the fasteners are properly and fully tightened so that the hinge member may be easily fixedly secured to the stile member of the door body. As shown in FIG. 5 which is an overall front view of the indoor side of the door, the hinge system of the present invention is mounted on each of the upper and lower ends of the inside surface of the stile member of the door body. The upper and lower hinge systems are vertically reverse in the manner of mounting, but are identical in construction, and therefore description of only the lower hinge system will be made hereinbelow, and that of the upper hinge system will be omitted herein.

Figure 1:
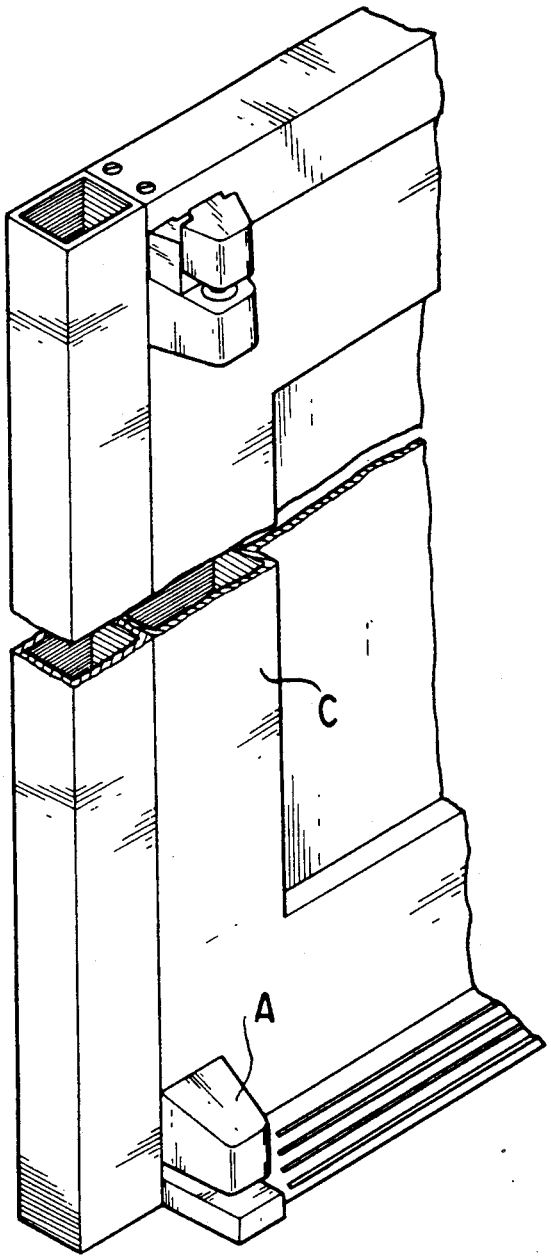
FIG. 1 PRIOR ART
FIGS. 1 and 2 show a prior art embodiment, FIG. 1 being a fragmentary perspective view showing a door body mounted on a door frame, and FIG. 2 being a longitudinal sectional view of a door hinge system.
Figure 2:
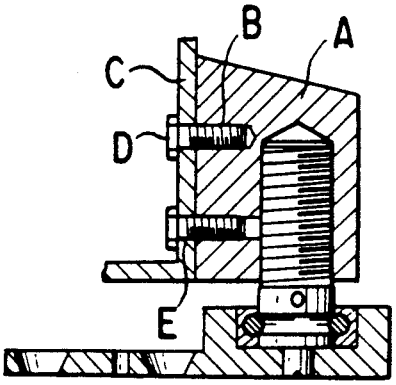
FIG. 2 PRIOR ART
Figure 3:
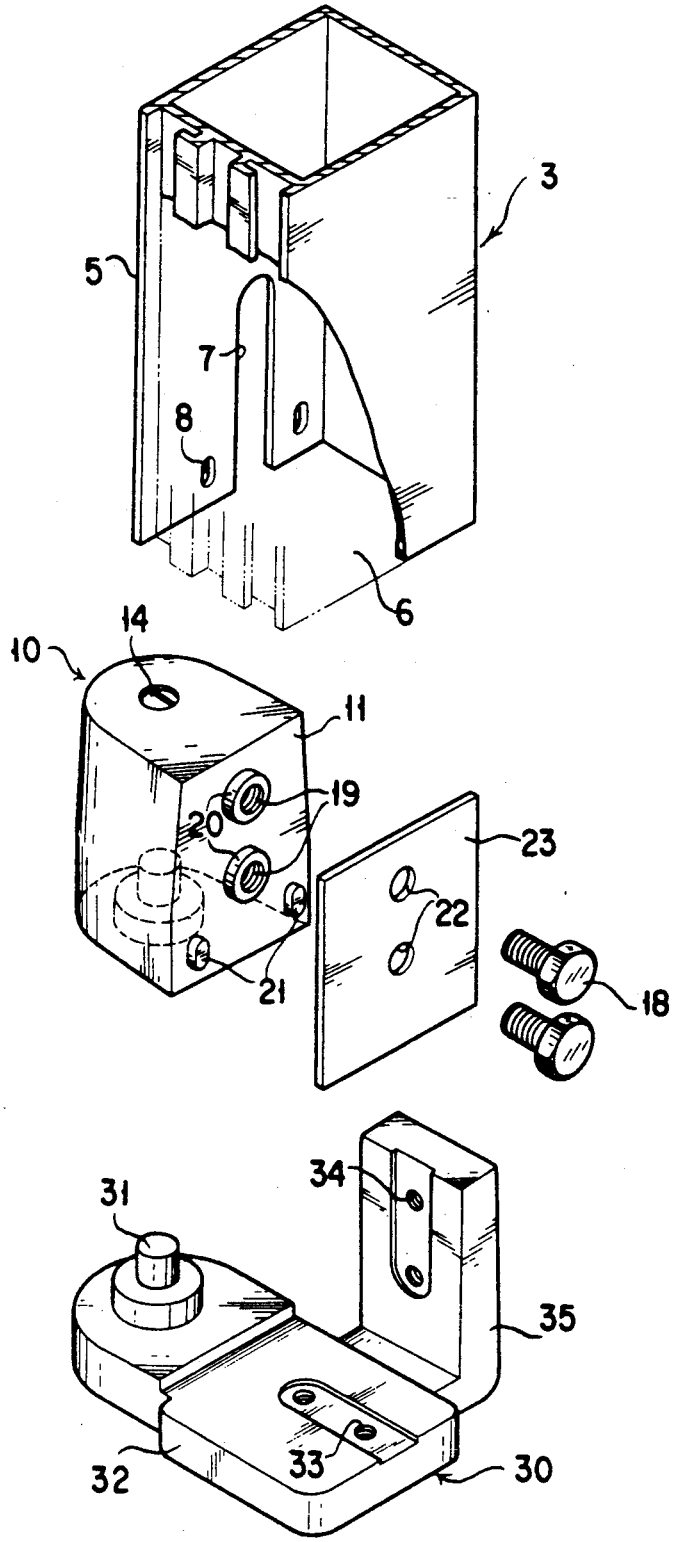
FIG. 3 is an exploded perspective view showing a first embodiment of a door hinge system according to the present invention.
Figure 4:
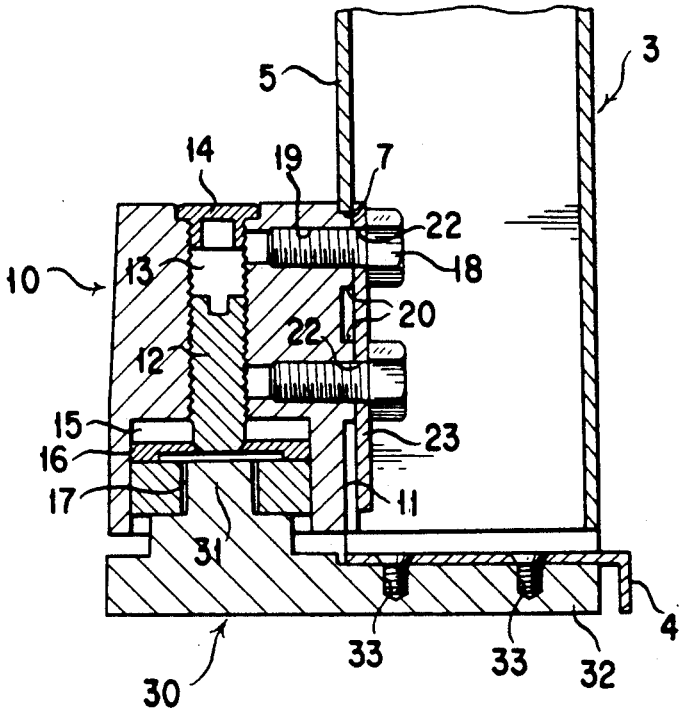
FIG. 4 is a longitudinal sectional view showing a condition that the hinge system is mounted on a stile member of a door body.

FIG. 3 is an exploded view showing a first embodiment of the hinge system according to the present invention, and FIG. 4 is s longitudinal sectional view showing a condition that the hinge system 1 is mounted on a stile member 3 of the door body.

A hinge member 10 of the hinge system 1 according to the present invention will first be described. The hinge member 10 is adapted to be mounted on the lower end of the stile member 3 of the door body 2. As shown in FIG. 3, the whole hinge member 10 is of a box shape, and has a planar mounting surface portion 11 formed on one side surface thereof and which is adapted to be mounted closely on one side wall 5 of the stile member 3 on the mounting side thereof. The hinge member 10 has a screw-threaded through-hole 13 formed substantially in the central part thereof and with which a pivot shape 12 is threadably engaged. The arrangement is made such that the leading end of the pivot shaft 12 threadably engaged with the through-hole 13 may be adjusted in vertical position depending on the mounting height of the door body 2 by turning the pivot shaft 12 by means of a screw driver or the like from above. Further, a dust-proof cap 14 is fitted in the upper part of the through-hole 13. The hinge member 10 has a circular recess 15 formed in the bottom part thereof, and in which is accommodated a pivot bearing 16 adapted to receive the pivot shaft 12. Further, this pivot bearing 16 has a hole 17 formed in the central part thereof, and in which a shaft portion 31 of a support member 30 is loosely fitted so as to enable the hinge member 10 to be rotatably supported. The mounting surface portion 11 of the hinge member 10 has two screw-threaded holes 19 formed therein in vertically spaced-apart and parallel relationship with each other. Formed integrally with and as extensions of the entry parts of the screw-threaded holes 19 are ring-shaped insert projections 20 which project from the mounting surface portion 11 by an amount substantially equal to the thickness of the side wall 5 of the stile member 3 on the mounting side thereof. The insert projections 20 are adapted to be fitted in a guide notch 7 formed in the side wall 5 and extending vertically from the lower end of the latter so that the fasteners 18 tightened temporarily through a seating plate 23 to the hinge member 10 may be inserted from an opening 6 formed in the lower part of the stile member 3 into the guide notch 7 thereby holding the door body 2. Further, the mounting surface portion 11 has two oval engaging portions 21 formed on the lower portions thereof near the left and right sides and which project by an amount nearly equal to the thickness of the side wall 5 of the stile member 3 in the same manner as the insert projections 20. The engaging portions 21 are adapted to be fitted in two slots 8, 8, respectively, formed in the lower portions of the side wall 5 of the stile member 3 so as to support the door body 2.

Next, description of the support member 30 is made. The support member 30 has a shaft portion 31 formed integrally therewith on one end thereof so as to project upwardly and adapted to be fitted loosely into a hole 17 formed in the pivot bearing 16 to thereby support the hinge member 10. Whilst, a base member 32 and a lateral holding member 35 have formed therein threaded holes 33 and 34 for set screws, respectively, for fixedly securing a lower frame 4 and a vertical frame 9, respectively.

To fixedly secure the hinge member 10 to the stile member 3 of the door body 2, the fasteners 18 are first inserted through two through-holes 22 formed in the seating plate 23 and each having a diameter equal to that of the screw-threaded holes 19 for fixedly securing the hinge member 10, and then the leading ends of the fasteners 18 are partially threadably engaged with the screw-threaded holes 19, respectively, in the hinge member 10 thereby making a temporary tightening. After that, the fasteners 18 tightened temporarily through the seating plate 23 to the hinge member 10 are inserted from the opening 6 formed in the lower part of the stile member 3 of the door body 2 into the guide notch 7 formed in the side wall 5 of the stile member 3, and then the hinge member 10 having the seating plate 23 fitted thereto by the temporarily tightened fasteners 18 is pulled upwards until the upper insert projection 20 is brought into contact with the upper or leading end of the guide notch 7. Whereupon, the insert projections 20 of the hinge member 10 are inserted in or engaged with the guide notch 7 in the side wall 5 of the stile member 3, and engaging portions 21 of the hinge member 10 are inserted in or engaged with the slots 8, 8, respectively, formed also in the side wall 5 of the stile member 3 thereby positioning the hinge system as shown in FIG. 4, and then the fasteners 18 are tightened properly or fully from inside the side wall 5 of the stile, thereby fixedly securing the hinge member 10 with the side wall 5 of the stile member 3 of the door body 2 being clamped between the mounting surface portion 11 of the hinge member 10 and the seating plate 23. Since, at that time, the insert projections 20 and the engaging portions 21 project by an amount nearly equal to the thickness of the side wall 5 of the stile member 3, the hinge system can be rigidly secured to the door body with the outer surfaces of the insert projections 20 and the engaging portions 21 kept flush with the inner surface of the side wall 5, and also the outer surface of the seating plate 23 kept flush with the inner surface of the side wall 5, and also the mounting surface portion 11 can carry the load of the door body 2 uniformly distributed thereon without any possibility of jolting and consequent damage of the mounting surface portion 11.

Figure 6:
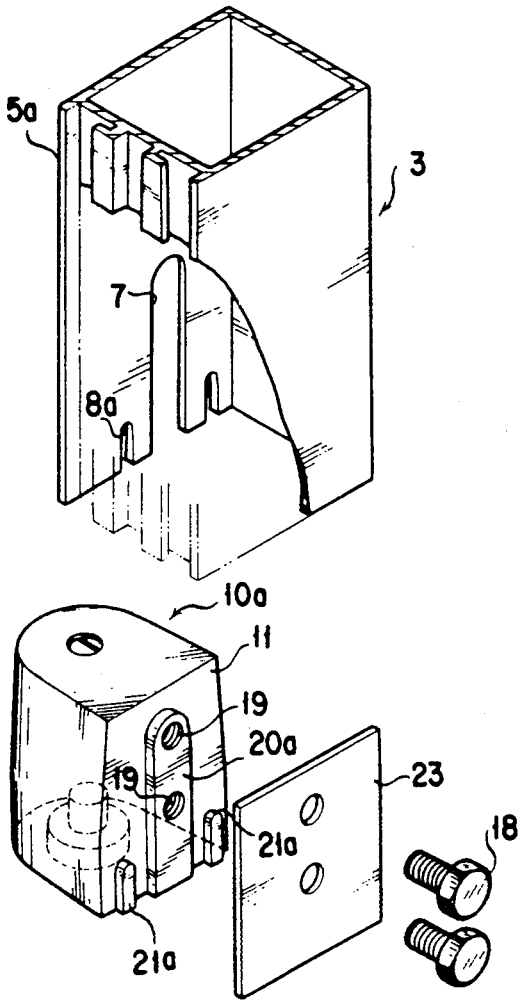
FIG. 6 is a fragmentary, exploded perspective view showing a modification of the first embodiment shown in FIG. 3.

FIG. 6 shows another embodiment comprising modifications of the insert projections and engaging portions of the hinge member of the first embodiment shown in FIG. 3. In this embodiment, an insert portion 20*a* is in the form of a vertically extending plate-shaped projection, and having the same shape as the guide notch 7, whilst engaging portions 21*a* are formed so as to extend downwardly to the lower end of a hinge member 10*a*. Therefore, the hinge member 10*a* is of such a configuration as can be manufactured more easily than the first embodiment. Further, slots 8*a* formed in a side wall 5*a* of the stile member 3 on the mounting side thereof and adapted to be 5 engaged with the engaging portions 21*a* are formed by cutting away the lower end of the side wall 5 in two places. Therefore, upon mounting the hinge member 10*a* on the stile member, the engaging portions 21*a* can be inserted in or engaged with the slots 8*a*, respectively, at the same time when the insert portion 20*a* is engaged with or fitted in the guide notch 7 only by pulling the hinge member 10 upwards so that the hinge system can be mounted on the door body more easily than the aforementioned embodiment.

Figure 7:
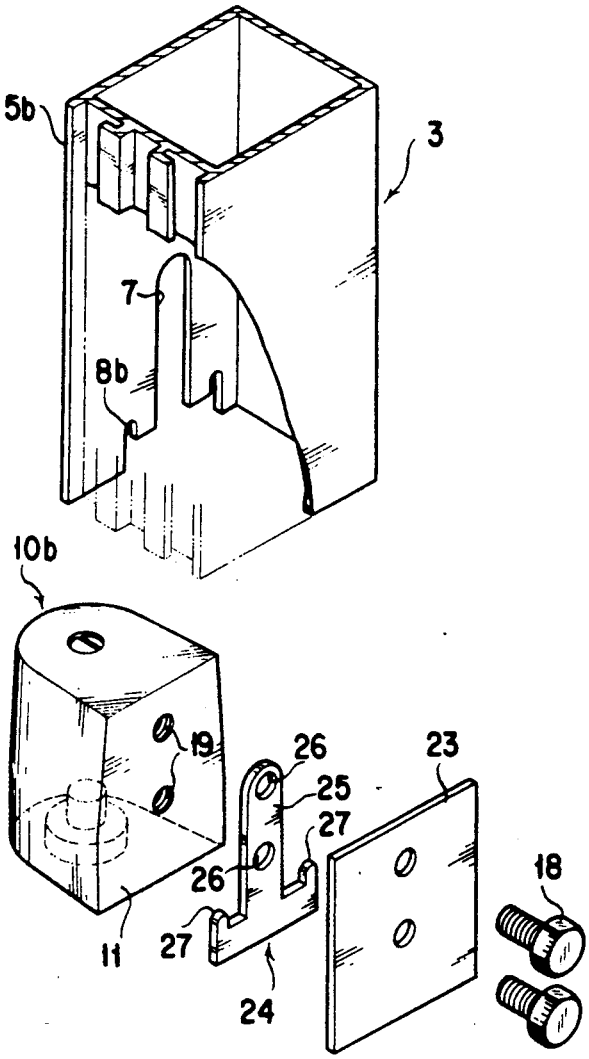
FIG. 7 is a fragmentary, exploded perspective view showing a second embodiment of the present invention.

FIG. 7 shows a second embodiment of the hinge system according to the present invention wherein an insert portion and engaging portions are formed on a separate plate-shaped member so that the hinge member can be fabricated more easily.

As shown in FIG. 7, an insert portion 25 and engaging portions 27 are formed integrally with a plate-shaped insert member 24 formed separately from a hinge member 10*b*. This insert member 24 is substantially E-shaped and formed by a plate-shaped member whose thickness is the same as that of the side wall 5*b* of the stile member 3. The insert member 24 comprises the insert portion 25 having two insert holes 26 formed therein in vertically spaced-apart relationship with each other and each having a diameter equal to that of each of mounting screw-threaded holes 19 formed in the hinge member 10*b*, and also engaging portions 27 formed on the left and right sides of the lower part thereof and which extend down to the lowermost end of the hinge member 10*b* when assembled with the latter, as in the case of the embodiment shown 20 in FIG. 6. The combined guide notch 7 and slots 8*b* formed in the side wall 5 of the stile member 3 has a configuration corresponding to that of the substantially E-shaped insert member 24. Upon mounting the hinge member 10*b* on the side wall 5*b* of the stile member 3, it is only necessary to interpose the insert member 24 between the hinge member 10*b* and the seating plate 23, tighten fasteners 18 temporarily, pull the hinge member 10*b* upwards through the opening formed in the lower part of the stile member 3, slots 8*b*, insert the temporarily 5 tightened assembly into the guide notch 7 and the slots 8*b* formed in the side wall 5*b* of the stile member 3, and then tighten the fasteners 18 properly or fully thereby fixedly securing the hinge member 10*b* to the stile member 3.

Figure 8:
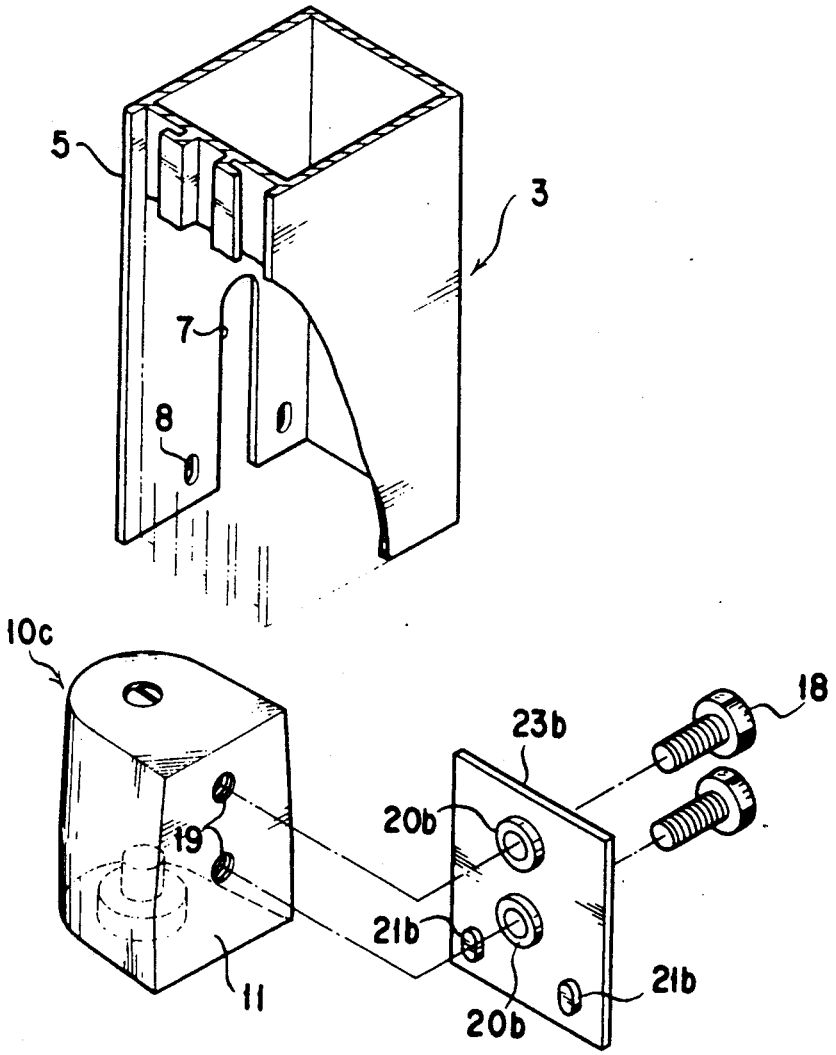
FIG. 8 is a fragmentary, exploded perspective view showing a third embodiment of the present invention.

FIG. 8 shows a third embodiment of the present invention.

In this embodiment, a seating plate 23*b*, which is brought into contact with the side wall 5 of the stile member 3 when a hinge member 10*c* is mounted on the latter, has insert projections 20*b* and engaging portions 21*b* formed so as to project from one side thereof. The shape and disposition of the insert projections 20*b* and the engaging portions 21*b*, respectively, are nearly the same as those of the insert projections 20 and the engaging portions 21 formed so as to project from the mounting surface portion 11 of the hinge member 10 of the hinge member 10 in the first embodiment. Therefore, the shape and disposition of the guide notch 7 and the slots 8 adapted to be engaged with the insert projections 20*b* 5 and the engaging portions 21*b* are the same as those of the guide notch 7 and the slots 8 of the first embodiment shown in FIG. 3. Further, the configuration of the hinge member 10*c* is identical to that of the hinge member 10*b* of the second embodiment.

It is to be understood that the foregoing description is merely illustrative of preferred embodiments of the present invention, and that the scope of the invention is not to be limited thereto, but is to be determined by the scope of the appended claims.

What is claimed is:

1. A hinge system comprising a hinge member adapted to be fixedly secured to a side wall of a stile member of a door body on the mounting side thereof, and a support member for supporting the hinge member from under or from above, the hinge system comprising: a mounting surface portion formed on one side surface of said hinge member, said mounting surface portion having a plurality of mounting screw-threaded holes formed therein in vertically spaced-apart and parallel relationship with each other; fasteners adapted to be threadably engaged with the mounting screw-threaded holes, respectively, to fixedly secure the hinge member to the side wall of said stile member; at least one insert portion located adjacent to the entry parts of said mounting screw-threaded holes and adapted to be inserted into a guide notch, for passage of said fasteners, formed in the side wall of the stile member; engaging portions located on the left and right side of the lower part of said mounting surface portion near the support member and adapted to be engaged with or fitted in slots formed in the side wall of the stile member on the mounting side thereof; said at least one insert portion and said engaging portions projecting from said mounting surface by an amount nearly equal to the thickness of said side wall; and a seating plate adapted to be abutted against the inner surface of the side wall of said stile member on the mounting side thereof and fixedly secured thereto by means of said fasteners, the arrangement being made such that said hinge member is fixedly secured to said stile member by temporarily tightening said sealing plate onto the mounting surface portion of said hinge member by means of said fasteners, inserting said hinge member from an opening formed in the lower part of the side wall of the stile member into the guide notch and the slots in such a manner that said side wall may be located at a predetermined position between the seating plate and the mounting surface portion, and then tightening said fasteners fully.

2. A hinge system as claimed in claim 1, characterized in that said insert portion(s) and said engaging portions are formed on a plate-shaped member formed separately from the hinge member.

3. A hinge system as claimed in claim 1, characterized in that said insert portion(s) and said engaging portions are formed at predetermined positions on the side surface of said seating plate facing the mounting surface portion of said hinge member.

4. A hinge system as claimed in claim 1, characterized in that said insert portions are ring-shaped members formed integrally so as to project from the entry parts of the mounting screw-threaded holes, respectively, perforated in said hinge member, whilst said engaging portions are oval portions formed on the left and right sides of the lower part of said mounting surface portion near said support member.

5. A hinge system as claimed in claim 1, characterized in that said insert portion is plate-shaped projection which, when assembled with said hinge member, extends vertically along the mounting screw-threaded holes perforated in the mounting surface portion of said hinge member and down to the lowermost end of said hinge member nearest to the support member, whilst said engaging portions are projections which, when assembled with said hinge member, extend vertically from the left and right sides of the lower part of said mounting surface portion on the side of said support member down to the lowermost end of the mounting surface portion nearest to said support member.

* * * * *